US005446469A

United States Patent [19]

Makino

[11] Patent Number: 5,446,469

[45] Date of Patent: Aug. 29, 1995

[54] EXTENDIBLE WHIP ANTENNA

[75] Inventor: Mitsuya Makino, Saitama, Japan

[73] Assignee: Nippon Antenna Co., Ltd., Tokyo, Japan

[21] Appl. No.: 345,557

[22] Filed: Nov. 28, 1994

Related U.S. Application Data

[63] Continuation of Ser. No. 88,568, Jul. 7, 1993, abandoned.

[30] Foreign Application Priority Data

Jan. 14, 1993 [JP] Japan ..... 5-021823

[51] Int. Cl.[6] ..... H01Q 1/24

[52] U.S. Cl. ..... 343/702; 343/895; 343/901

[58] Field of Search ..... 343/702, 895, 900, 903, 343/906, 715, 901; H01Q 1/24, 11/08

[56] References Cited

U.S. PATENT DOCUMENTS

| | | | |
|---|---|---|---|
| 4,121,218 | 10/1978 | Irwin et al. | 343/895 |
| 4,725,845 | 2/1988 | Phillips | 343/702 |
| 4,868,576 | 9/1989 | Johnson, Jr. | 343/702 |
| 5,317,325 | 5/1994 | Bottomley | 343/702 |

*Primary Examiner*—Donald Hajec
*Assistant Examiner*—Hoanganh Le
*Attorney, Agent, or Firm*—Flynn, Thiel, Boutell & Tanis

[57] ABSTRACT

An extendible whip antenna suitable for a hand-held two-way radio apparatus having a wide frequency band and a high sensitivity is disclosed, in which when it is used for communication, a ½-wave length whip antenna is extended outside of a case and a stopper conductor thereof is engaged with a holder conductor so that it is connected with a radio circuit through a matching circuit together with a ½-wave length helical antenna element.

9 Claims, 3 Drawing Sheets

EXTENDIBLE WHIP ANTENNA

This application is a continuation of U.S. Ser. No. 08/088,568, filed Jul. 7, 1993, now abandoned.

FIELD OF THE INVENTION

The present invention relates to improvement of an extendible whip antenna suitable for a hand-held two-way radio apparatus such as a portable cellular telephone, etc.

BACKGROUND OF THE INVENTION

As a prior art extendible whip antenna used for a hand-held two-way radio apparatus such as a portable cellular telephone, etc. there are known those disclosed e.g. in JP-A-Hei 2-271701, U.S. Pat. No. 4,121,218, etc.

The whip antenna disclosed in JP-A-Hei 2-271701 utilizes a ½-wave length spring antenna element and a ½-wave length fixed helical element capacitively coupled therewith. When it is not used, the spring antenna element is accommodated in a case of the hand-held two-way radio apparatus through the helical antenna so that a state where communication is feasible is kept by the helical antenna element. On the other hand, when it is used, the spring antenna element is extended.

However problems in a whip antenna thus constructed are that fabrication of the spring antenna element is not easy in practice and that it is difficult to obtain a predetermined degree of coupling with the helical antenna.

On the other hand, the whip antenna disclosed in the U.S. patent specification stated above is constructed similarly to that described previously except that a linearly extendible whip antenna element is used in lieu of the spring antenna element. In this antenna the whip antenna element extended at use is capacitively coupled with the helical antenna element.

A problem in this case consists in that since matching of the whip antenna with a radio circuit is adjusted by varying the length of the whip antenna element and the gap (capacitive coupling) between the two antenna elements, regulation thereof is tedious and it is difficult to expect to effect it with a high precision.

Further, as a problem common to the two antennas described above, it should be noted that since the helical antenna element is of ¼-wave length sensitivity thereof when the whip antenna element is accommodated in the case of the radio circuit is low and that the received frequency band thereof is narrow. This is due to the fact that they are so constructed that the two antenna elements are fed through capacitive coupling in series.

OBJECT OF THE INVENTION

The object of the present invention is to solve the problematical points of the prior art extendible whip antennas described above and to provide an extendible whip antenna suitable for a hand-held two-way radio apparatus having a wide frequency band and a high gain.

SUMMARY OF THE INVENTION

In order to achieve the above object, an extendible whip antenna according to the present invention is characterized in that it comprises a ½-wave length helical antenna element disposed on a case of a radio circuit; a rod-shaped ½-wave length whip antenna element, which can be accommodated in or extended outside of the case through the helical antenna element; a holder conductor supporting the helical antenna element; and a stopper conductor disposed on a lower end portion of the whip antenna element, wherein when the whip antenna element is extended, the stopper conductor is engaged with the holder conductor, the holder conductor being connected with a radio circuit portion in the case through a matching circuit, and the rod-shaped whip antenna element is covered by an insulator longer than the helical antenna element, disposed so as to be extended from an upper end portion of the whip antenna element.

In the extendible whip antenna according to the present invention, when it is used for communication, the ½-wave length whip antenna element is extended outside of the case and used together with the ½-wave length helical antenna element. On the other hand, when it is not used, the whip antenna element is accommodated in the case and only the helical antenna element is used.

DETAILED EXPLANATION

Figure 1A:
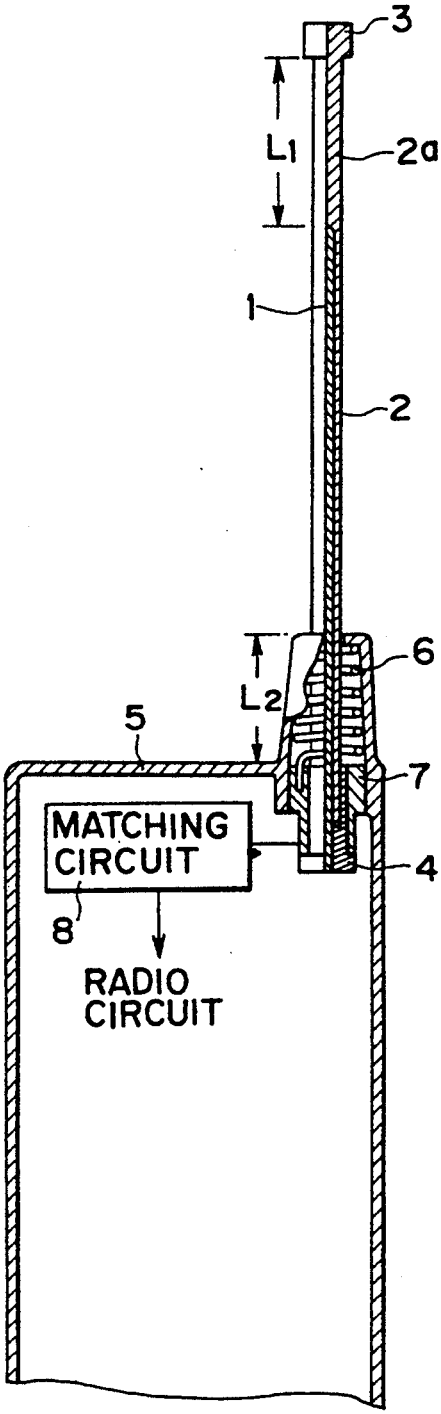
FIGS. 1A and 1B are schematical diagrams of an extendible whip antenna according to an embodiment of the present invention, when it is extended and accommodated in the case, respectively.

Hereinbelow the embodiment of the present invention indicated in the drawings will be explained.

Figure 1B:
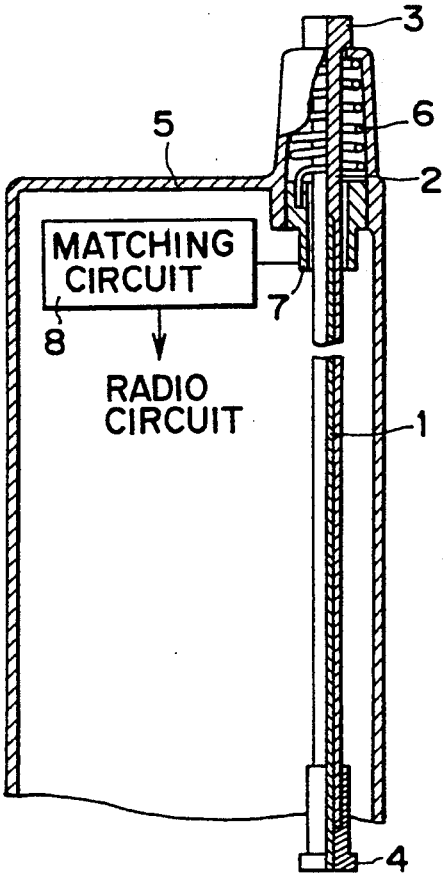

FIGS. 1A and 1B show an embodiment of the extendible whip antenna according to the present invention. In the figures, reference numeral 1 is a ½-wave length whip antenna element, which is covered by an insulator 2. This insulator 2 is extended from the upper end of the whip antenna element 1 to a top portion 3 of the insulator. Further a stopper conductor 4 is disposed on the lower end portion of the whip antenna element 1, these two portions being conductively contacted with each other.

5 is a case of a hand-held two-way radio apparatus (transceiver), a part of which protrudes, where a ½-wave length helical antenna element 6 is located, which element is supported by a holder conductor 7. This holder conductor 7 is connected with a radio circuit not indicated in the figure through a matching circuit 8.

Further the whip antenna element 1 can be accommodated in the case 5 through the helical antenna element 6, as indicated in FIG. 1B. On the other hand, when it is extended outside of the case 5 as indicated in FIG. 1A, a state is realized where it is connected with the radio circuit described above through the matching circuit 8 owing to engagement of the stopper conductor 4 with the holder conductor 7.

Figure 2A:
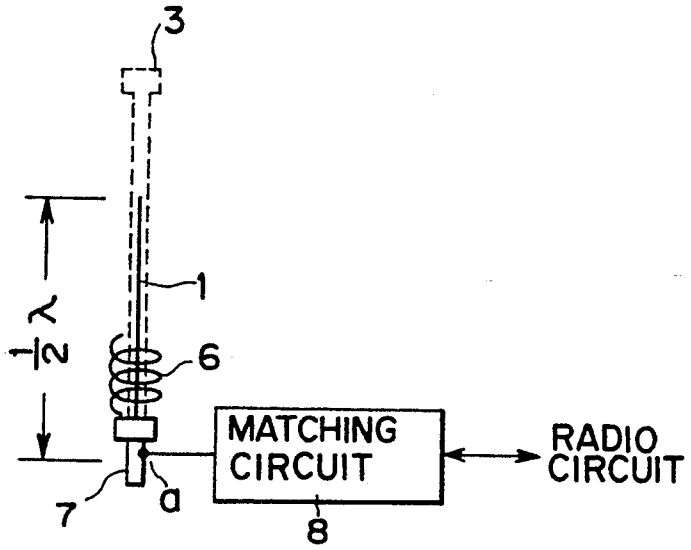
FIGS. 2A and 2B are diagrams for explaining operation of the embodiment described above.

When the whip antenna element 1 is extended, the whip antenna element 1 and the helical antenna element 6 are connected with the matching circuit 8 in parallel, as indicated in FIG. 2A. In the total antenna characteristics in this case those of the whip antenna element 1 are predominant. In this state, compared with characteristics of prior art similar antennas, the frequency band is enlarged by the present embodiment. This effect can be obtained because the thickness of the whip antenna element 1 is equivalently increased by the fact that the two antenna elements described above are connected in parallel. The helical antenna element and the whip antenna element connected in parallel exhibit the effect to increase the frequency band width by a side effect.

Further impedance at a point a on the holder conductor 7 is about 200 to 300 Ω. In order to realize matching with the radio circuit, impedance transformation of about 4:1 is effected by the matching circuit 8 and thus antenna emission efficiency can be increased.

Next, when the whip antenna element 1 is accommodated in the case, it is in a state indicated in FIG. 1B. In this case, in order to prevent interference between the two antenna elements due to the fact that no part of the whip antenna element 1 remains inside the helical antenna element 6, it is preferable that the length L1 of the extension 2*a* of the insulator 2 is greater than the length L2 of the helical antenna element 6 (L1>L2).

Figure 2B:
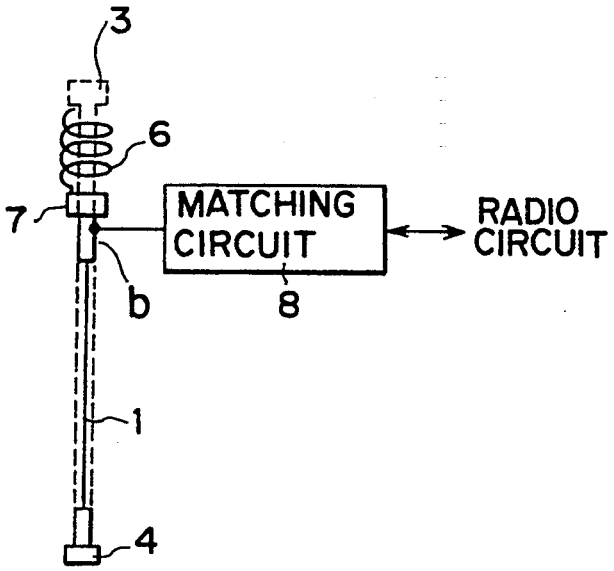

In this case, although impedance at a point b in FIG. 2B is somewhat lower than the impedance when the whip antenna element is extended, the matching circuit 8 can be used in practice, as it is, without any hindrance.

Figure 3:
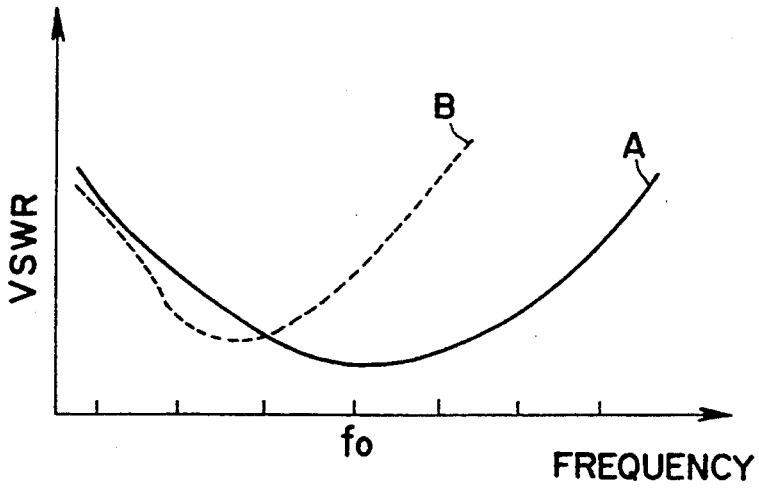
FIG. 3 shows characteristic curves of the embodiment described above.

FIG. 3 indicates the relation between the voltage standing wave ratio (VSWR) and the frequency f for the embodiment described above, in which A indicates a characteristic curve when the whip antenna element is extended, while B represents same when it is accommodated in the case. The resonance frequency when it is accommodated in the case can be arbitrarily set, equal to, higher or lower than $f_o$.

As explained above, according to the present invention, since emission lowering when an operator uses the radio apparatus in a state where it is held by hand can be prevented by using a whip antenna element and a helical antenna element, both of which are of ½-wave length, and further the ½-wave length whip antenna element and the ½-wave length helical antenna element can be directly fed, when the whip antenna is connected with the radio circuit through the matching circuit by engaging the stopper conductor with the holder conductor supporting the helical antenna element, it is possible to make the whip antenna and the helical antenna simultaneously work, to increase in this way field intensity emitted by the antenna system, to enlarge the frequency band and thus to provide a hand-held two-way radio apparatus for communication capable of solving problems of prior art techniques.

What is claimed is:

1. In an apparatus which includes:

a helical antenna element disposed on a case of a radio circuit;

a matching circuit connected to said helical antenna element and to said radio circuit; and a whip antenna element which can be accommodated in or extended outside of said case through said helical antenna element;

the improvement comprising said helical antenna element and said whip antenna element each having a ½-wave length, and connecting means for conductively and directly connecting said matching circuit through a conductive coupler to said whip antenna element when said whip antenna element is extended, so that said antenna elements are conductively and directly connected in parallel with each other to said matching circuit.

2. An apparatus according to claim 1, wherein said conductive coupler includes a holder conductor supporting said helical antenna element and includes a stopper conductor disposed on a lower end portion of said whip antenna element, wherein when said whip antenna element is extended, said stopper conductor is engaged with said holder conductor, said holder conductor being connected with said radio circuit in said case through said matching circuit.

3. An apparatus according to claim 2, further including an insulator covering said whip antenna element and having an extended portion which projects above an upper end portion of said whip antenna element and which is longer than a vertical height of said helical antenna.

4. An apparatus according to claim 1, further including an insulator covering said whip antenna element and having an extended portion which projects above an upper end portion of said whip antenna element and which is longer than a vertical height of said helical antenna.

5. An apparatus, comprising: a case, an elongate whip antenna having an elongate conductive whip element of ½-wave length and supported on said case for lengthwise movement along an axis relative to said case between a retracted position disposed substantially within said case and an extended position in which a portion thereof projects outwardly from said case, a conductive helical antenna element of ½-wave length supported on said case so as to extend helically around said axis, said whip antenna extending through said helical antenna element, a radio circuit disposed in said case, a matching circuit disposed in said case and electrically coupled to said radio circuit, and means electrically coupling said matching circuit to said helical antenna element, and respectively effecting and interrupting an electrical coupling of said matching circuit to said whip element when said whip antenna is respectively in said extended and retracted positions, said means include a holder conductor supported on said case and electrically coupled to said matching circuit and said helical antenna element, said whip element being electrically and conductively and directly coupled to said holder conductor and being free of electrical coupling to said holder conductor when said whip antenna is respectively in said extended and retracted positions.

6. An apparatus according to claim 5, wherein said whip antenna includes an elongate insulator having said whip element therein, and wherein said means includes a further conductor mounted on one end of said whip antenna and electrically connected to said whip element, said further conductor respectively directly contacting and being axially spaced from said holder conductor when said whip antenna is respectively in said extended and retracted positions.

7. An apparatus according to claim 6, including cooperating means on said holder conductor and further conductor for preventing movement of said whip antenna beyond said extended position.

8. An apparatus according to claim 7, wherein said insulator has at an outer end thereof an enlarged portion which is engagable with said case in said retracted position for preventing movement of said whip antenna beyond said retracted position.

9. An apparatus according to claim 5, wherein said whip antenna includes a nonconductive end portion extending a predetermined axial distance outwardly beyond an outer end of said whip element, wherein said helical antenna element has a dimension in a direction parallel to said axis which is less than said predetermined axial distance, and wherein said end portion of said whip antenna is substantially axially aligned with said helical antenna element when said whip antenna is in said retracted position.

* * * * *